US010202878B2

(12) United States Patent
Noguchi et al.

(10) Patent No.: US 10,202,878 B2
(45) Date of Patent: Feb. 12, 2019

(54) VALVE OPENING AND CLOSING TIMING CONTROL APPARATUS

(71) Applicant: AISIN SEIKI KABUSHIKI KAISHA, Kariya-shi, Aichi (JP)

(72) Inventors: Yuji Noguchi, Obu (JP); Takeo Asahi, Kariya (JP); Toru Sakakibara, Anjo (JP)

(73) Assignee: AISIN SEIKI KABUSHIKI KAISHA, Kariya-Shi, Aichi (JP)

( * ) Notice: Subject to any disclaimer, the term of this patent is extended or adjusted under 35 U.S.C. 154(b) by 55 days.

(21) Appl. No.: 15/318,943

(22) PCT Filed: Aug. 25, 2015

(86) PCT No.: PCT/JP2015/073830
§ 371 (c)(1),
(2) Date: Dec. 14, 2016

(87) PCT Pub. No.: WO2016/031808
PCT Pub. Date: Mar. 3, 2016

(65) Prior Publication Data

US 2017/0122138 A1 May 4, 2017

(30) Foreign Application Priority Data

Aug. 27, 2014 (JP) ..... 2014-173015

(51) Int. Cl.
*F01L 1/34* (2006.01)
*F01L 1/047* (2006.01)
(Continued)

(52) U.S. Cl.
CPC ..... *F01L 1/3442* (2013.01); *F01L 1/047* (2013.01); *F01L 1/0532* (2013.01);
(Continued)

(58) Field of Classification Search
CPC . F01L 1/3442; F01L 1/047; F01L 2001/3445; F01L 2001/34433; F01L 2001/34426
See application file for complete search history.

(56) References Cited

U.S. PATENT DOCUMENTS

2005/0066924 A1 3/2005 Lehmann et al.
2007/0095315 A1 5/2007 Hoppe et al.
(Continued)

FOREIGN PATENT DOCUMENTS

CN 103244223 A 8/2013
DE 10 2008 057 491 A1 5/2010
(Continued)

OTHER PUBLICATIONS

U.S. Appl. No. 15/319,216, filed Dec. 15, 2016, Asahi et al.
(Continued)

*Primary Examiner* — Mark A Laurenzi
*Assistant Examiner* — Wesley G Harris
(74) *Attorney, Agent, or Firm* — Buchanan Ingersoll & Rooney PC

(57) ABSTRACT

A valve opening and closing timing control apparatus includes a driving-side rotation member, a driven-side rotation member, a tubular member provided at an inner portion of the driven-side rotation member, a bolt in a tubular form provided at an inner side of the tubular member, an introduction passage provided at least at one of the bolt and the tubular member between the bolt and the tubular member and bringing a working fluid to flow in the rotation axis direction, an introduction communication passage provided at the bolt to bring the working fluid at the introduction passage to flow to an inner side of the bolt, an advanced angle communication passage and a retarded angle communication passage provided at different positions from each
(Continued)

other in a longitudinal direction of the rotation axis, and a control valve body provided at the inner side of the bolt.

9 Claims, 6 Drawing Sheets

(51) Int. Cl.
*F01L 1/344* (2006.01)
*F01L 1/053* (2006.01)

(52) U.S. Cl.
CPC ..... *F01L 2001/0476* (2013.01); *F01L 2001/3443* (2013.01); *F01L 2001/3445* (2013.01); *F01L 2001/34426* (2013.01); *F01L 2001/34433* (2013.01); *F01L 2001/34463* (2013.01); *F01L 2001/34469* (2013.01); *F01L 2001/34479* (2013.01); *F01L 2001/34483* (2013.01); *F01L 2250/02* (2013.01); *F01L 2820/041* (2013.01)

(56) References Cited

U.S. PATENT DOCUMENTS

2008/0149057 A1* 6/2008 Grunow ..... F01L 1/3442 123/90.17
2012/0060779 A1 3/2012 Adachi et al.
2012/0097122 A1* 4/2012 Lichti ..... F01L 1/3442 123/90.15
2012/0255509 A1 10/2012 Lichti et al.
2013/0199469 A1 8/2013 Busse et al.
2014/0352488 A1* 12/2014 Puetz ..... F01L 1/3442 74/568 R

FOREIGN PATENT DOCUMENTS

JP 2009-515090 A 4/2009
JP 2012-036768 A 2/2012
JP 2012-057578 A 3/2012
JP 2012-219815 A 11/2012

OTHER PUBLICATIONS

Notification of Transmittal of Translation of the International Preliminary Report on Patentability (Forms PCT/IB/338 and PCT/IB/373) and the Written Opinion of the International Searching Authority (Form PCT/ISA/237) dated Mar. 9, 2017, by the International Bureau of WIPO in corresponding International Application No. PCT/JP2015/073830. (9 pgs).
International Search Report (PCT/ISA/210) dated Nov. 24, 2015, by the Japan Patent Office as the International Searching Authority for International Application No. PCT/JP2015/073830.
Written Opinion (PCT/ISA/237) dated Nov. 24, 2015, by the Japan Patent Office as the International Searching Authority for International Application No. PCT/JP2015/073830.

* cited by examiner

VALVE OPENING AND CLOSING TIMING CONTROL APPARATUS

TECHNICAL FIELD

This invention relates to a valve opening and closing timing control apparatus including a driving-side rotation member which rotates synchronously with a drive shaft of an internal combustion engine and a driven-side rotation member which rotates integrally with a camshaft for opening and closing a valve of the internal combustion engine, the valve opening and closing timing control apparatus changing a relative rotational phase between the driving-side rotation member and the driven-side rotation member.

BACKGROUND ART

Each of Patent documents 1 to 3 discloses a valve opening and closing timing control apparatus which includes a bolt in a tubular form connecting a driven-side rotation member and a camshaft to each other. In the aforementioned valve opening and closing timing control apparatus, an introduction passage extending in a longitudinal direction of a rotation axis is provided as a flow passage for supplying working fluid to an advanced angle chamber and a retarded angle chamber. An advanced angle communication passage and a retarded angle communication passage penetrating through the bolt in a direction intersecting with the rotation axis are provided at the bolt so that the working fluid is configured to separately flow to an advanced angle flow passage and a retarded angle flow passage. The advanced angle communication passage and the retarded angle communication passage are provided at different positions from each other along a circumferential direction of the rotation axis and at different positions from each other along the longitudinal direction of the rotation axis relative to the introduction passage. A control valve body which reciprocates along the rotation axis is provided at an inside of the bolt so that the working fluid from the introduction passage is switchably supplied to the advanced angle communication passage and the retarded angle communication passage depending on a position of the control valve body.

DOCUMENT OF PRIOR ART

PATENT DOCUMENT

Patent document 1: JP2009-515090A
Patent document 2: US20120097122A1
Patent document 3: DE102008057491A1

OVERVIEW OF INVENTION

PROBLEM TO BE SOLVED BY INVENTION

According to the valve opening and closing timing control apparatus disclosed in Patent document 1, a tubular member (sleeve) which defines an introduction passage (pressure medium passage) relative to a bolt (valve housing) is provided between the bolt and a control valve body (control piston) at an inner side of the bolt. Thus, the tubular member may be worn away with a reciprocation of the control valve body. Sealing ability at a boundary face between the control valve body and the tubular member may decrease, which may result in leakage of working fluid from the boundary face between the control valve body and the tubular member. In a case where the working fluid leaks from the boundary face between the control valve body and the tubular member, a supply speed of the working fluid to the advanced angle chamber or the retarded angle chamber decreases to deteriorate control responsiveness of a relative rotational phase.

According to the valve opening and closing timing control apparatus disclosed in Patent document 2, the tubular member is provided at an outer side of the bolt and the introduction passage is disposed between the tubular member and the driven-side rotation member. In the aforementioned construction, abrasion caused by the reciprocation of the control valve body is inhibited from being generated at the tubular member and therefore leakage of working fluid because of decrease of sealing ability is unlikely to occur. Nevertheless, because an annular groove, a supply passage constituted by a penetration bore connected to the annular groove and an advanced angle passage or a retarded angle passage connected to the annular groove are provided at a tubular wall portion of the tubular member, a manufacture of the tubular member may be complicated.

According to the valve opening and closing timing control apparatus disclosed in Patent document 3, the tubular member at an inner portion of which the introduction passage is provided is arranged between the bolt and the driven-side rotation member at an outer side of the bolt. In the aforementioned construction, abrasion caused by the reciprocation of the control valve body is inhibited from being generated at the tubular member and therefore the leakage of working fluid because of the decrease of sealing ability is unlikely to occur. Nevertheless, because of a configuration where a force for tightening the driven-side rotation member to a camshaft is applied to the tubular member, the tubular member may be deformed. The deformation of the tubular member leads to leakage of working fluid from a boundary face between the control valve body and the tubular member. The supply speed of the working fluid to the advanced angle chamber or the retarded angle chamber decreases to deteriorate control responsiveness of a relative rotational phase. In view of the aforementioned condition, it is desirable to provide a valve opening and closing timing control apparatus where a flow passage of working fluid may be easily defined and which improves control responsiveness of a relative rotational phase.

MEANS FOR SOLVING PROBLEM

According to a characteristic construction of a valve opening and closing timing control apparatus of the present invention, the valve opening and closing timing control apparatus includes a driving-side rotation member synchronously rotating with a drive shaft of an internal combustion engine, a driven-side rotation member supported at an inner side of the driving-side rotation member to be rotatable at a rotation axis serving as a common rotation axis between the driven-side rotation member and the driving-side rotation member, the driven-side rotation member integrally rotating with a camshaft for opening and closing a valve of the internal combustion engine, a tubular member provided at an inner portion of the driven-side rotation member, a bolt in a tubular form provided at an inner side of the tubular member to connect the driven-side rotation member and the camshaft to each other, an advanced angle chamber and a retarded angle chamber defined and provided between the driving-side rotation member and the driven-side rotation member, an advanced angle flow passage and a retarded angle flow passage provided at the driven-side rotation member, the advanced angle flow passage being in communication with the advanced angle chamber, the retarded angle flow passage being in communication with the retarded angle chamber, an introduction passage provided at least at one of the bolt and the tubular member between the bolt and the tubular member, the introduction passage bringing a working fluid supplied from an outside to flow along a longitudinal direction of the rotation axis, an introduction communication passage provided at the bolt to bring the working fluid at the introduction passage to flow to an inner side of the bolt, an advanced angle communication passage and a retarded angle communication passage provided at different positions from each other along the longitudinal direction of the rotation axis of the bolt, and a control valve body provided at the inner side of the bolt to reciprocate along the rotation axis, the control valve body supplying the working fluid from the introduction communication passage to one of the advanced angle communication passage and the retarded angle communication passage.

The aforementioned valve opening and closing timing control apparatus includes the tubular member provided at the inner portion of the driven-side rotation member, the bolt in the tubular form provided at the inner side of the tubular member to connect the driven-side rotation member and the camshaft to each other and the control valve body provided at the inner side of the bolt to reciprocate along the rotation axis. Therefore, abrasion along with the reciprocation of the control valve body is inhibited from occurring at the tubular member. As a result, leakage of working fluid caused by decrease of sealing ability is unlikely to occur.

In addition, the valve opening and closing timing control apparatus includes the bolt in the tubular form provided at the inner side of the tubular member and the introduction passage provided at least at one of the bolt and the tubular member between the bolt and the tubular member. Because the introduction passage is arranged at a different phase relative to the advanced angle flow passage and the retarded angle flow passage in a circumferential direction, the sealing ability improves as compared to the introduction passage which is arranged side by side relative to the advanced angle flow passage and the retarded angle flow passage along an axial direction. According to the aforementioned valve opening and closing timing control apparatus, the leakage of working fluid caused by the decrease of sealing ability is unlikely to occur so that control responsiveness of a relative rotational phase may improve. The tubular member which defines the introduction passage relative to the bolt may be easily manufactured.

According to the other characteristic construction, the advanced angle communication passage and the retarded angle communication passage penetrate through the bolt and the tubular member in a direction intersecting with the rotation axis, the advanced angle communication passage and the retarded angle communication passage being provided at different positions from each other along a circumferential direction of the rotation axis relative to the introduction passage so that the working fluid at the inner side of the bolt flows separately to the advanced angle flow passage and the retarded angle flow passage.

According to the aforementioned construction, the sealing ability between the advanced angle communication passage and the retarded angle communication passage improves as compared to a case where the advanced angle communication passage and the retarded angle communication passage are arranged at the same phases in the circumferential direction.

According to the other characteristic construction, the valve opening and closing timing control apparatus includes a circumferential positioning portion which determines a relative position between the bolt and the tubular member in the circumferential direction relative to the rotation axis.

According to the aforementioned construction, the relative position of the bolt and the tubular member around the rotation axis is determined so that a position of a flow passage of the working fluid provided at the bolt and a position of a flow passage of the working fluid provided at the tubular member may accurately match each other around the rotation axis.

According to the other characteristic construction, the valve opening and closing timing control apparatus includes an axial positioning portion which determines a relative position between the bolt and the tubular member in a direction along the rotation axis.

According to the aforementioned construction, the relative position of the bolt and the tubular member in the direction along the rotation axis is determined so that the position of the flow passage of the working fluid provided at the bolt and the position of the flow passage of the working fluid provided at the tubular member may accurately match each other in the direction along the rotation axis.

According to the other characteristic construction, a relative position between the bolt and the tubular member is determined by fitting of the bolt and the tubular member to each other.

Accordingly, because of a simple construction where the bolt and the tubular member are fitted to each other, the relative position of the bolt and the tubular member around the rotation axis and the relative position of the bolt and the tubular member in the direction along the rotation axis may be both determined. Thus, without a special construction such as an engagement portion for engaging the bolt and the tubular member each other or an adhesive portion for adhering the bolt and the tubular member each other, for example, the flow passage of the working fluid provided at the bolt and the flow passage of the working fluid provided at the tubular member may be accurately arranged around the rotation axis and in the direction along the rotation axis.

According to the other characteristic construction, the tubular member is made of one of an aluminum-based material and a resin material.

Accordingly, a low-strength material such as the aluminum-based material and the resin material, for example, is employed for the tubular member so that the bolt serving as a high-strength material is inhibited from directly making contact with the driven-side rotation member. The driven-side rotation member is unlikely to be damaged upon insertion of the bolt into the driven-side rotation member. Further, a material including a greater linear expansion than the bolt may be employed for the tubular member and then the tubular member is fitted to the bolt so that the decrease of sealing ability between the tubular member and the bolt may be unlikely to occur.

According to the other characteristic construction, the introduction passage is provided at an outer peripheral surface of the bolt while an advanced angle annular flow passage connecting the advanced angle communication passage and the advanced angle flow passage to each other and a retarded angle annular flow passage connecting the retarded angle communication passage and the retarded angle flow passage to each other are provided at an inner peripheral surface of the driven-side rotation member.

Accordingly, it is not necessary to provide an elongated groove, for example, constituting the introduction passage at an inner peripheral surface of the tubular member. Further, it is not necessary to provide a peripheral groove, for example, constituting each of the advanced angle annular flow passage and the retarded angle annular flow passage at an outer peripheral surface of the tubular member. The construction of the tubular member may be therefore simplified.

According to the other characteristic construction, the introduction passage is provided at an outer peripheral surface of the bolt while an advanced angle annular flow passage connecting the advanced angle communication passage and the advanced angle flow passage to each other and a retarded angle annular flow passage connecting the retarded angle communication passage and the retarded angle flow passage to each other are provided at an outer peripheral surface of the tubular member.

Accordingly, it is not necessary to provide the elongated groove, for example, constituting the introduction passage at the inner peripheral surface of the tubular member. The construction of the tubular member may be therefore simplified. In addition, it is not necessary to provide the peripheral groove, for example, constituting each of the advanced angle annular flow passage and the retarded angle annular flow passage may be effectively provided at the outer peripheral surface of the tubular member without providing the peripheral groove at the inner peripheral surface of the driven-side rotation member, i.e., at the inner peripheral surface which is difficult to be confirmed from the outside.

According to the other characteristic construction, the introduction passage is provided at an inner peripheral surface of the tubular member while an advanced angle annular flow passage connecting the advanced angle communication passage and the advanced angle flow passage to each other and a retarded angle annular flow passage connecting the retarded angle communication passage and the retarded angle flow passage to each other are provided at an inner peripheral surface of the driven-side rotation member.

Accordingly, it is not necessary to provide the elongated groove, for example, constituting the introduction passage at the outer peripheral surface of the bolt. Strength of the bolt may be easily secured and the construction of the bolt may be simplified.

MODE FOR CARRYING OUT THE INVENTION

Embodiments of the present invention are explained with reference to the attached drawings.

[First Embodiment]

Figure 1:
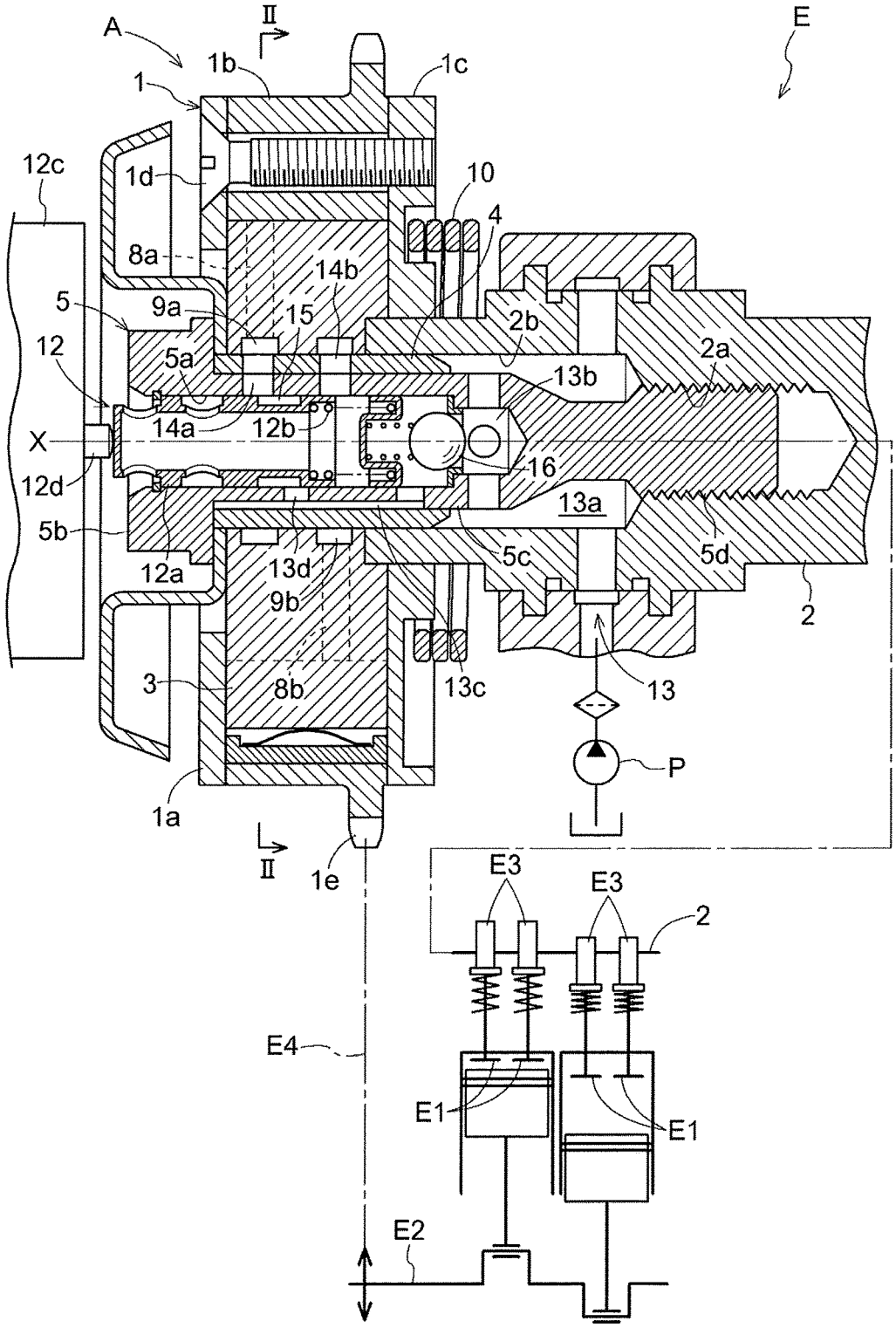
FIG. 1 is a cross-sectional view illustrating an entire construction of a valve opening and closing timing control apparatus.
Figure 2:
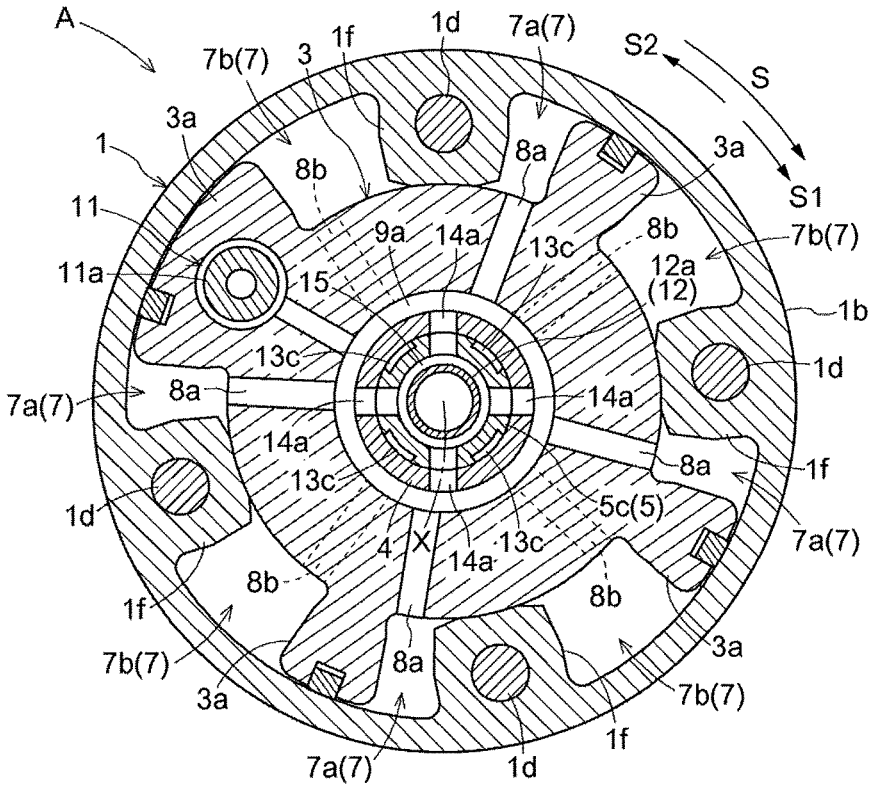
FIG. 2 is a cross-sectional view taken along a line II-II in FIG. 1.

A valve opening and closing timing control apparatus A according to the present embodiment is illustrated in FIGS. 1 to 6. The valve opening and closing timing control apparatus A controls opening and closing timing of intake valves E1 of an engine E of an automobile. As illustrated in FIGS. 1 and 2, the valve opening and closing timing control apparatus A includes a housing 1 and an inner rotor 3. The housing 1 which is made of aluminum alloy rotates synchronously with a crankshaft E2 of the engine E about a rotation axis X. The inner rotor 3 which is made of aluminum alloy is supported to be rotatable about the same rotation axis X at an inner side of the housing 1 and rotates integrally with a camshaft 2 for opening and closing intake valves.

A sleeve 4 made of resin or aluminum alloy and an OCV bolt 5 made of steel and connecting the inner rotor 3 and the camshaft 2 to each other are provided at an inner portion of the inner rotor 3. The OCV bolt 5 that is inserted to be positioned at an inner side of the sleeve 4 includes a tubular shaft portion 5*c* where an inner void 5*a* opens to a bolt head 5*b* and a solid externally-threaded portion 5*d*.

The camshaft 2 is a rotation shaft of cams E3 which control opening and closing of the intake valves E1 of the engine E. The camshaft 2 is rotatably supported at a cylinder head of the engine E to rotate synchronously with the inner rotor 3 and the OCV bolt 5. A screw bore 2*b* is coaxially provided at a connection side of the camshaft 2 with the inner rotor 3. An internally-threaded portion 2*a* is provided at a back side of the screw bore 2*b*. The OCV bolt 5 coaxially fastens and fixes the inner rotor 3 to the camshaft 2 in a state where the externally-threaded portion 5*d* is screwed with the internally-threaded portion 2*a* provided at the camshaft 2.

In the embodiment, the engine E of the automobile corresponds to an internal combustion engine. In addition, the crankshaft E2 corresponds to a drive shaft of the internal combustion engine. Further, the housing 1 corresponds to a driving-side rotation member while the inner rotor 3 corresponds to a driven-side rotation member. Furthermore, the sleeve 4 corresponds to a tubular member.

Figure 6:
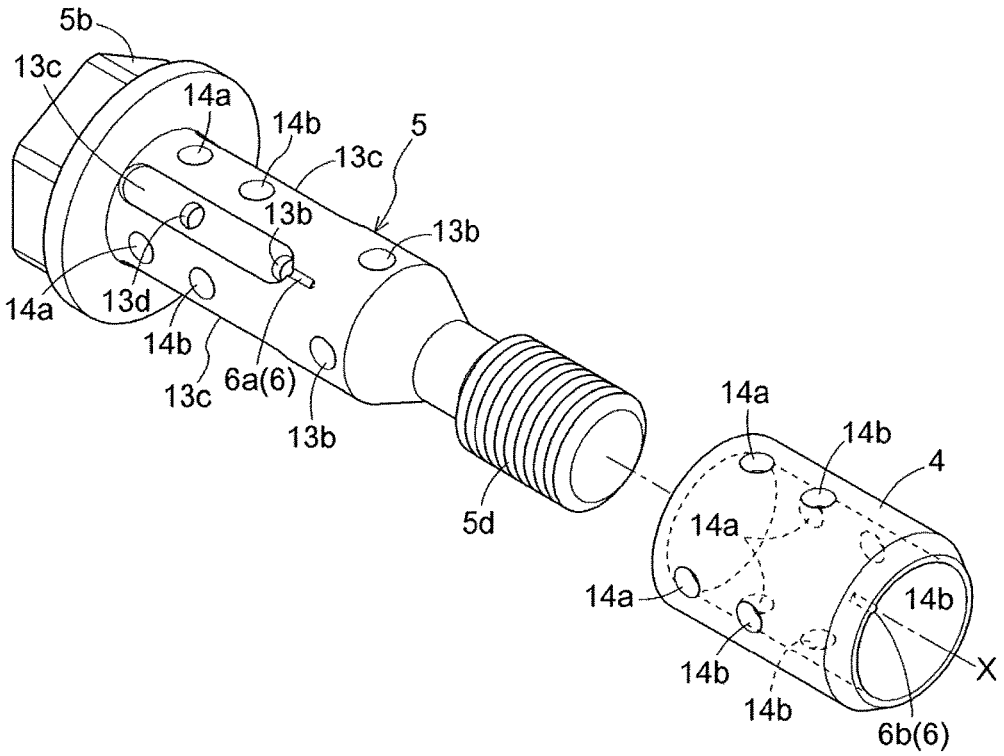
FIG. 6 is an exploded perspective view illustrating a bolt and a tubular member (sleeve)

A positioning portion 6 is provided at and over the OCV bolt 5 and the sleeve 4 for determining a relative position between the OCV bolt 5 and the sleeve 4. As illustrated in FIG. 6, the positioning portion 6 includes an engagement recess portion 6*a* which is recessed at an outer peripheral surface of the tubular shaft portion 5*c* and an engagement protruding portion 6*b* protruding at an inner peripheral surface of the sleeve 4. The engagement protruding portion 6*b* is brought to engage with the engagement recess portion 6*a* in association with an operation for externally fitting the sleeve 4 to the tubular shaft portion 5*c*.

Accordingly, the positioning portion 6 includes a function as a circumferential positioning portion for determining the relative position in a circumferential direction relative to the rotation axis X and a function as an axial positioning portion for determining the relative position in a direction along the rotation axis X. Instead of the positioning portion 6 where the engagement protruding portion 6*b* engages with the engagement recess portion 6*a*, the tubular shaft portion 5*c* and the sleeve 4 may fit to each other for determining the relative position between the OCV bolt 5 and the sleeve 4.

The housing 1 is constituted by a front plate 1*a*, an outer rotor 1*b* and a rear plate 1*c* which are integrally connected to one another by connection bolts 1*d*. The front plate 1*a* is disposed at an opposite side from a side where the camshaft 2 is present. The outer rotor 1*b* is externally mounted to the inner rotor 3. The rear plate 1*c* is disposed at the side where the camshaft 2 is present. The outer rotor 1*b* integrally includes a timing sprocket 1*e*. An endless rotary body E4 such as a metal chain, for example, operating in conjunction with the rotation of the crankshaft E2 is wound at the timing sprocket 1*e*.

In a case where the crankshaft E2 is driven to rotate, a rotary power thereof is transmitted to the outer rotor 1*b* via the endless rotary body E4 so that the housing 1 rotates in a rotation direction S illustrated in FIG. 2. In association with a rotary drive of the housing 1, the inner rotor 3 is driven to rotate in the rotation direction S, which results in the rotation of the camshaft 2. The cams E3 then press down the intake valves E1 of the engine E to open the intake valves E1.

As illustrated in FIG. 2, the inner rotor 3 is housed within the housing 1 to define and provide fluid pressure chambers 7 between the housing 1 and the inner rotor 3. The fluid pressure chambers 7 are defined by plural protruding portions 1*f* provided at the outer rotor 1*b* at intervals in the rotation direction S, the protruding portions 1*f* protruding radially inward. Each of the fluid pressure chambers 7 is further defined into an advanced angle chamber 7*a* and a retarded angle chamber 7*b* in the rotation direction S by a protruding portion 3*a* which is provided at the inner rotor 3, the protruding portion 3*a* protruding radially outward.

Advanced angle flow passages 8*a* in communication with the respective advanced angle chambers 7*a* and retarded angle flow passages 8*b* in communication with the respective retarded angle chambers 7*b* are provided at the inner rotor 3 so as to penetrate through the inner rotor 3 along a radial direction of the rotor. The advanced angle flow passages 8*a* are provided at different positions from the retarded angle flow passages 8*b* in the direction of the rotation axis X. The advanced angle flow passages 8*a* are in communication with an advanced angle annular flow passage 9*a* serving as an annular circumferential groove at an inner peripheral surface of the inner rotor 3. The retarded angle flow passages 8*b* are in communication with a retarded angle annular flow passage 9*b* serving as an annular circumferential groove at the inner peripheral surface of the inner rotor 3.

Supply, discharge or interruption of supply and discharge of oil (working fluid) relative to the advanced angle chambers 7*a* and the retarded angle chambers 7*b* through the advanced angle flow passages 8*a* and the retarded angle flow passages 8*b* generates oil pressure at each of the protruding portions 3*a* so that a relative rotational phase is displaced in an advanced angle direction or a retarded angle direction or is held at any phase. A spring 10 engages over the camshaft 2 and the rear plate 1*c* so as to bias the inner rotor 3 in the advanced angle direction relative to the housing 1.

The advanced angle direction is a direction in which a volume of each of the advanced angle chambers 7*a* increases as illustrated by an arrow S1 in FIG. 2. The retarded angle direction is a direction in which a volume of each of the retarded angle chambers 7*b* increases as illustrated by an arrow S2 in FIG. 2. The relative rotational phase in a case where the volume of the advanced angle chamber 7*a* is at maximum is a most advanced angle phase. The relative rotational phase in a case where the volume of the retarded angle chamber 7*b* is at maximum is a most retarded angle phase.

A lock mechanism 11 is provided so as to selectively lock the relative rotational phase of the inner rotor 3 relative to the housing 1 at a lock phase between the most advanced angle phase and the most retarded angle phase by locking a relative rotation movement of the inner rotor 3 relative to the housing 1. The lock mechanism 11 includes a lock member 11*a* which protrudes and retraces in the direction of the rotation axis X by a control of oil pressure. The relative rotational phase is locked at the lock phase by an engagement of the lock member 11*a* with the front plate 1*a* or the rear plate 1*c*. The lock mechanism 11 may be configured to lock the relative rotational phase at either the most advanced angle phase or the most retarded angle phase.

In the present embodiment, an OCV (oil control valve) 12 corresponds to a control valve. The OCV 12 is coaxially provided with the camshaft 2. The OCV 12 switches between the supply and discharge of the oil relative to the advanced angle chambers 7*a* and the retarded angle chambers 7*b* through the advanced angle flow passages 8*a* and the retarded angle flow passages 8*b* so that the relative rotational phase between the housing 1 and the inner rotor 3 is changed between the most advanced angle phase and the most retarded angle phase. The OCV 12 includes a spool 12*a* in a tubular form, a spring 12*b* biasing the spool 12*a* and an electromagnetic solenoid 12*c* driving and moving the spool 12*a* against a biasing force of the spring 12*b*.

The spool 12*a* is housed at an inner side of the OCV bolt 5, i.e., at the inner void 5*a* of the tubular shaft portion 5*c*, so as to slidably reciprocate along the direction of the rotation axis X. The spool 12*a* is constantly biased by the spring 12*b* to a side where the spool 12*a* protrudes outward from the inner void 5*a*. The spool 12*a* corresponds to a control valve body.

In a case where the electromagnetic solenoid 12*c* is powered, a push pin 12*d* presses the spool 12*a* so that the spool 12*a* slidably moves towards the camshaft 2 against the biasing force of the spring 12*b*. In the OCV 12, the position of the spool 12*a* is adjustable by adjustment of a duty ratio of an electric power supplied to the electromagnetic solenoid 12*c*. A power supply amount to the electromagnetic solenoid 12*c* is controlled by an ECU (electronic control unit) not illustrated.

A supply flow passage 13 is provided so as to selectively supply the oil which is supplied by an oil pump P from the outside such as an oil pan, for example, to the advanced angle flow passages 8*a* or the retarded angle flow passages 8*b* via the OCV 12. The supply flow passage 13 includes a bolt outer peripheral flow passage 13*a*, bolt inner flow passages 13*b*, introduction passages 13*c*, introduction communication passages 13*d*, advanced angle communication passages 14*a* and retarded angle communication passages 14*b*. The bolt outer peripheral flow passage 13*a* is provided at the screw bore 2*b* of the camshaft 2 so as to surround an outer peripheral side of the OCV bolt 5. The bolt inner flow passages 13*b* are provided at an inner portion of the OCV bolt 5. The introduction passages 13*c* are provided at the outer peripheral surface of the tubular shaft portion 5*c* between the OCV bolt 5 and the sleeve 4 to bring the oil from the bolt inner flow passages 13*b* to flow along the longitudinal direction of the rotation axis X. The introduction communication passages 13*d* are provided at a tubular wall of the tubular shaft portion 5*c* in a penetrating manner so as to bring the oil introduced from the introduction passages 13*c* to flow to an inner side of the tubular shaft portion 5*c*. The advanced angle communication passages 14*a* and the retarded angle communication passages 14*b* penetrate through the OCV bolt 5 and the sleeve 4 in a tube diameter direction intersecting with the rotation axis X.

Each of the advanced angle communication passages 14*a* and each of the retarded angle communication passages 14*b* are arranged at different positions from each other along the longitudinal direction of the rotation axis X and at different positions from each other along the circumferential direction of the rotation axis X relative to the introduction passage 13*c* so that the oil at the inner side of the OCV bolt 5 flows separately to each of the advanced angle flow passages 8*a* and each of the retarded angle flow passages 8*b*. The spool 12*a* includes a valve body peripheral groove 15 which is annularly formed at an outer peripheral surface of the spool 12*a*. The spool 12*a* switches the oil flowing from the introduction communication passages 13*d* between an advanced angle control state where the oil is supplied to the advanced angle chambers 7*a* via the advanced angle communication passages 14*a*, the advanced angle annular flow passage 9*a* and the advanced angle flow passages 8*a* and a retarded angle control state where the oil is supplied to the retarded angle chambers 7*b* via the retarded angle communication passages 14*b*, the retarded angle annular flow passage 9*b* and the retarded angle flow passages 8*b*.

A ball-type check valve 16 is provided at the inside of the tubular shaft portion 5*c* and is positioned at a portion of the bolt inner flow passage 13*b*. The check valve 16 interrupts a flow of the oil to the introduction passages 13*c* and blocks a backflow of the oil from the introduction passages 13*c* in a case where a supply pressure of the oil is equal to or smaller than a setting pressure. The check valve 16 permits a flow of the oil to the introduction passages 13*c* in a case where the supply pressure of the oil exceeds the setting pressure.

Figure 3:
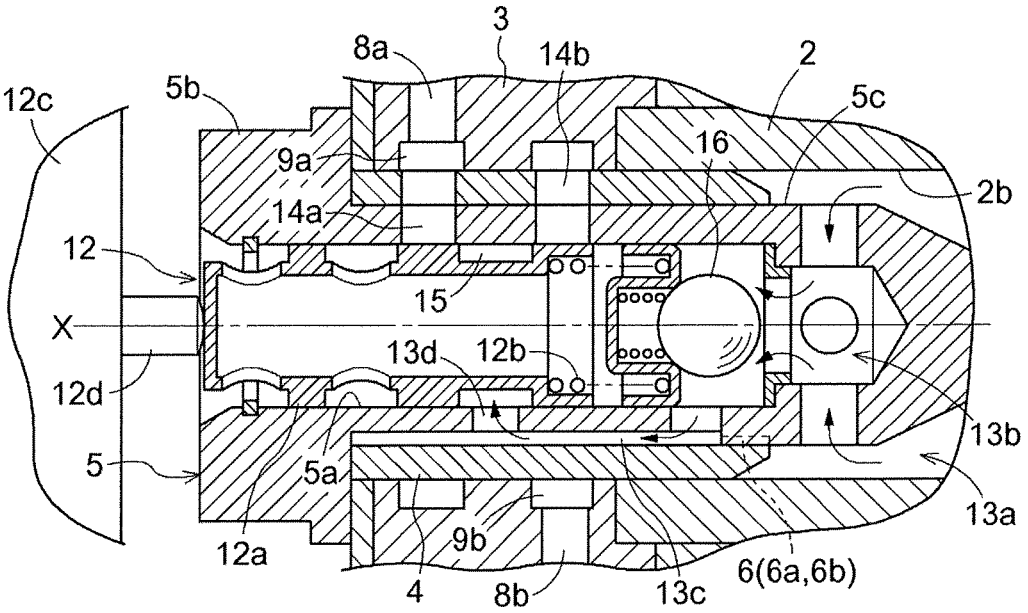
FIG. 3 is a cross-sectional view illustrating a position of a control valve body in a neutral state.

FIG. 3 illustrates a neutral state of the spool 12*a* where the spool 12*a* is moved to a position at which the introduction communication passage 13*d* only is in communication with the valve body peripheral groove 15 and neither the advanced angle communication passage 14*a* nor the retarded angle communication passage 14*b* is in communication with the valve body peripheral groove 15. In the neutral position, the supply and discharge of the oil relative to the advanced angle chambers 7*a* and the retarded angle chambers 7*b* is stopped so that the relative rotational phase is inhibited from being changed.

Figure 4:
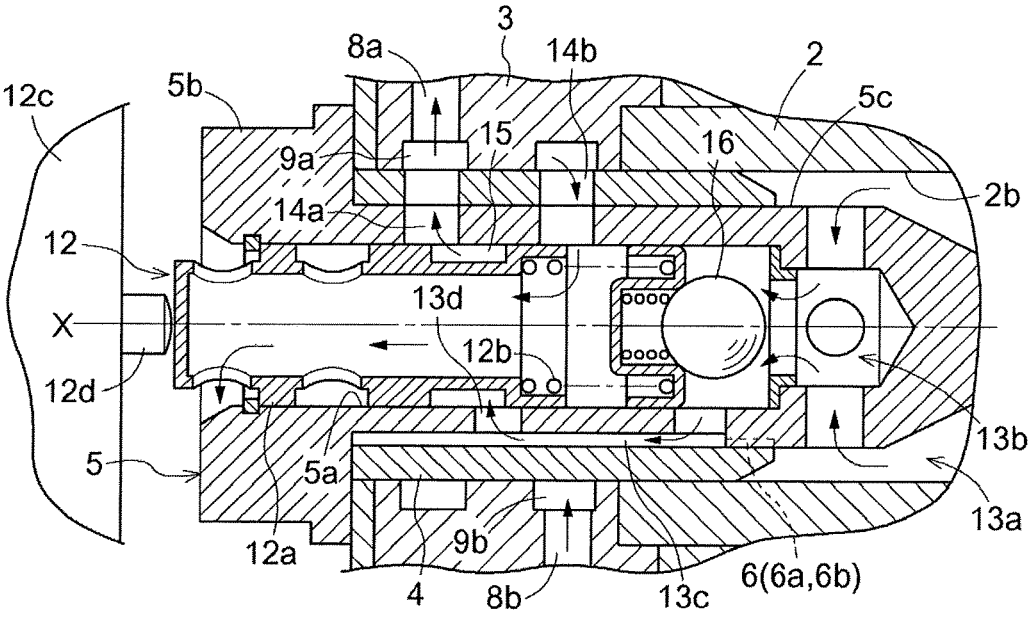
FIG. 4 is a cross-sectional view illustrating a position of the control valve body in an advanced angle control state.

FIG. 4 illustrates the advanced angle control state of the spool 12*a* where the spool 12*a* is moved to a position at which the introduction communication passage 13*d* and the advanced angle communication passage 14*a* are in communication with each other via the valve body peripheral groove 15 and the retarded angle communication passage 14*b* is in communication with the inner void 5*a*. In the advanced angle control state, the oil is supplied to the advanced angle chambers 7*a* via the advanced angle flow passages 8*a* and the oil at the retarded angle chambers 7*b* is discharged to the outside from the retarded angle communication passages 14*b* through the retarded angle flow passages 8*b* so that the relative rotational phase is changed to the advanced angle direction.

Figure 5:
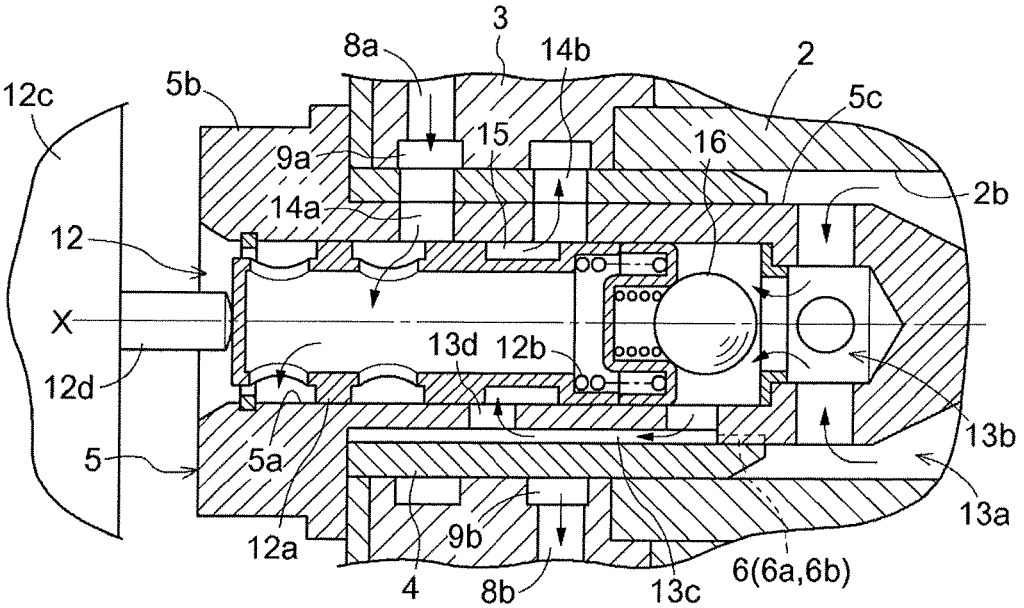
FIG. 5 is a cross-sectional view illustrating a position of the control valve body in a retarded angle control state.

FIG. 5 illustrates the retarded angle control state of the spool 12*a* where the spool 12*a* is moved to a position at which the introduction communication passage 13*d* and the retarded angle communication passage 14*b* are in communication with each other via the valve body peripheral groove 15 and the advanced angle communication passage 14*a* is in communication with the inner void 5*a*. In the retarded angle control state, the oil is supplied to the retarded angle chambers 7*b* through the retarded angle flow passages 8*b* and the oil at the advanced angle chambers 7*a* is discharged to the outside through the advanced angle flow passages 8*a* so that the relative rotational phase is changed to the retarded angle direction.

In the present embodiment, the sleeve 4 which defines the introduction passages 13*c* relative to the tubular shaft portion 5*c* is externally fitted and fixed to the tubular shaft portion 5*c*. Thus, the sleeve 4 may be secured without being sandwiched between the inner rotor 3 and the camshaft 2 in the direction of the rotation axis X. Because a compression force caused by fastening of the OCV bolt 5 is inhibited from being applied to the sleeve 4, the sleeve 4 is inhibited from being deformed even in a case where the sleeve 4 is made of a material including a low strength such as aluminum alloy and resin, for example. As a result, the sealing ability of each flow passage is maintained to reasonably obtain the valve opening and closing timing control apparatus A with improved responsiveness of a phase control while flexibility in selection of materials of the sleeve 4 increases.

[Second Embodiment]

Figure 7:
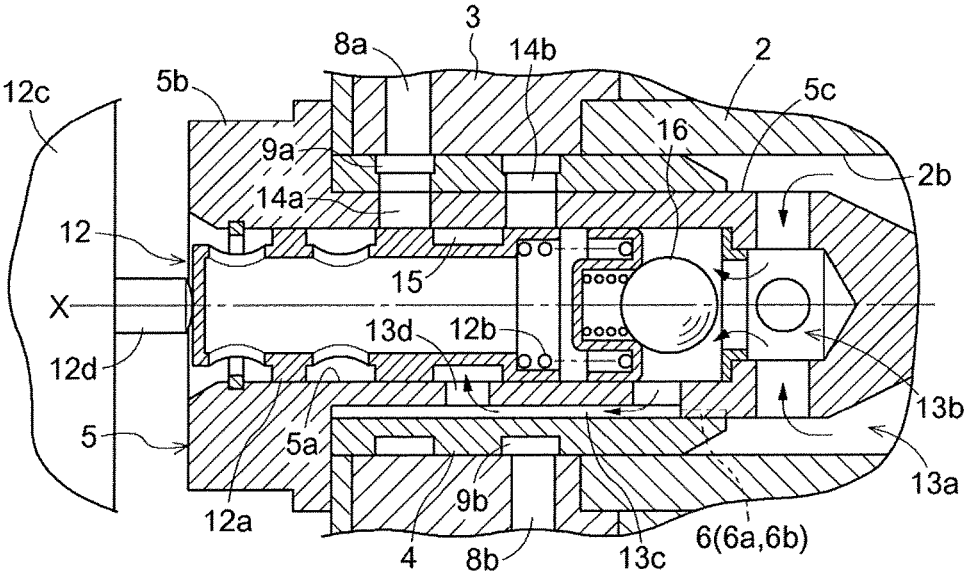
FIG. 7 is a cross-sectional view of a main portion according to a second embodiment.

FIG. 7 illustrates the valve opening and closing timing control apparatus A according to a second embodiment. The valve opening and closing timing control apparatus A of the present embodiment differs from the first embodiment in that the introduction passage 13*c* is provided at the outer peripheral surface of the tubular shaft portion 5*c* while the advanced angle annular flow passage 9*a* connecting the advanced angle communication passage 14*a* and the advanced angle flow passage 8*a* to each other and the retarded angle annular flow passage 9*b* connecting the retarded angle communication passage 14*b* and the retarded angle flow passage 8*b* to each other are provided at an outer peripheral surface of the sleeve 4. The other construction is similar to the first embodiment.

[Third Embodiment]

Figure 8:
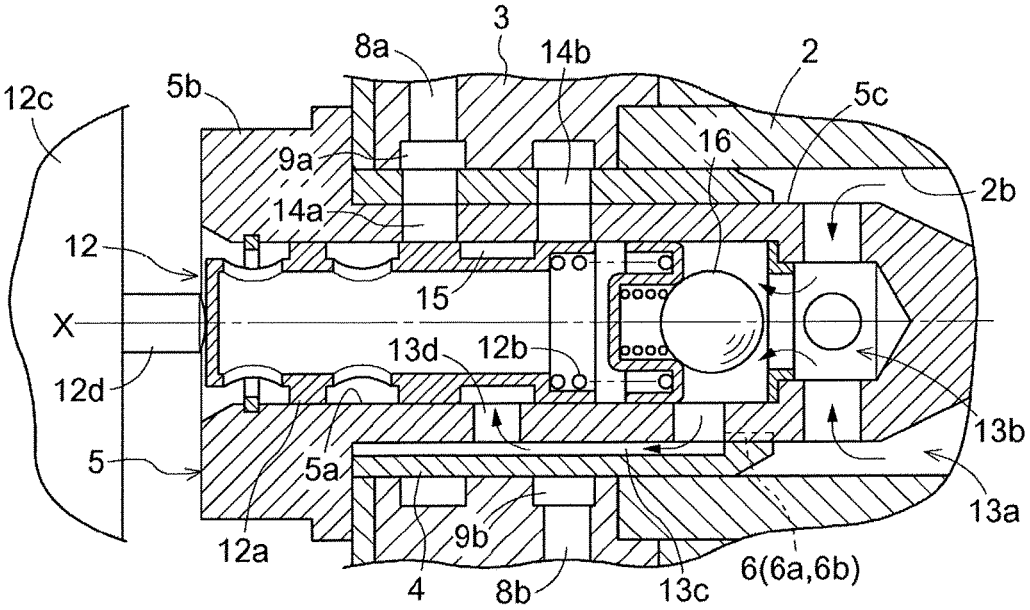
FIG. 8 is a cross-sectional view of a main portion according to a third embodiment.
Figure 9:
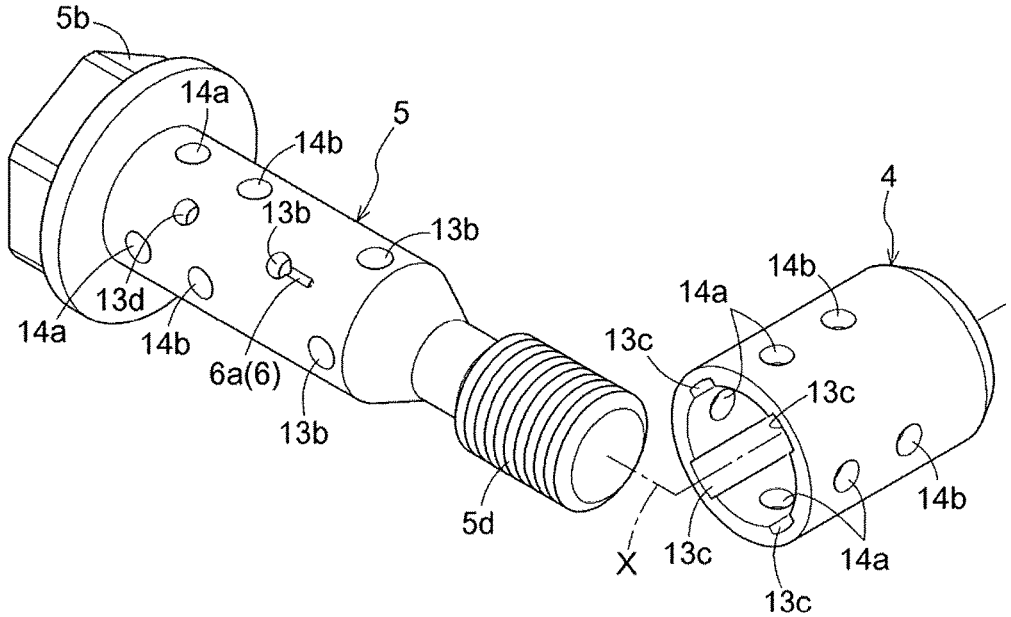
FIG. 9 is an exploded perspective view illustrating the bolt and the tubular member according to the third embodiment.

FIGS. 8 and 9 illustrate the valve opening and closing timing control apparatus A according to a third embodiment. The valve opening and closing timing control apparatus A of the present embodiment differs from the first embodiment in that the introduction passage 13*c* is provided at the inner peripheral surface of the sleeve 4 while the advanced angle annular flow passage 9*a* connecting the advanced angle communication passage 14*a* and the advanced angle flow passage 8*a* to each other and the retarded angle annular flow passage 9*b* connecting the retarded angle communication passage 14*b* and the retarded angle flow passage 8*b* to each other are provided at the inner peripheral surface of the inner rotor 3. The other construction is similar to the first embodiment.

[Fourth Embodiment]

Figure 10:
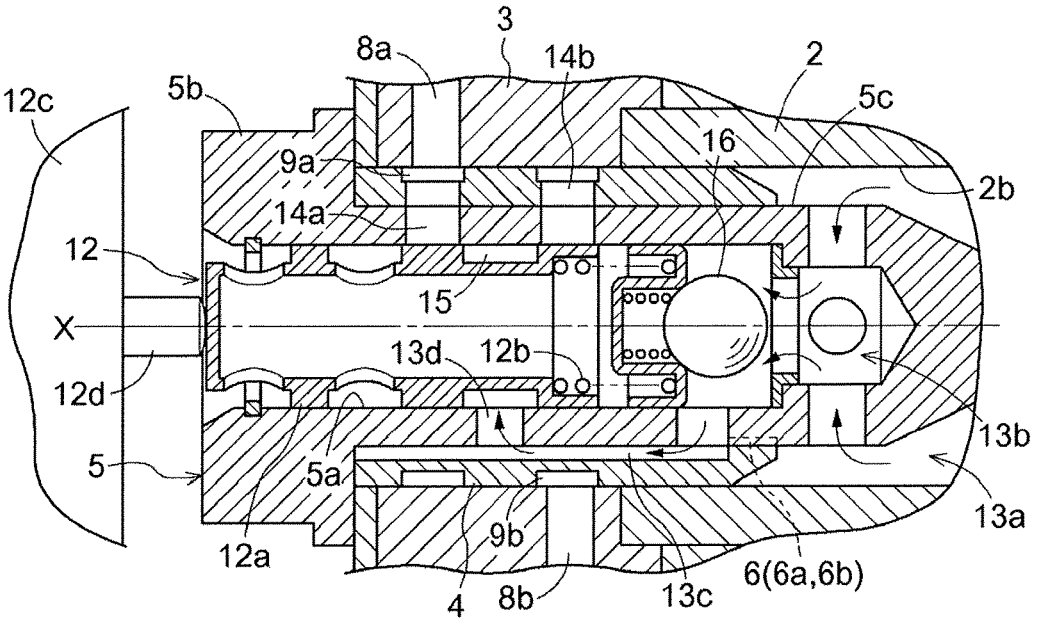
FIG. 10 is a cross-sectional view of a main portion according to a fourth embodiment.

FIG. 10 illustrates the valve opening and closing timing control apparatus A according to a fourth embodiment. The valve opening and closing timing control apparatus A of the present embodiment differs from the first embodiment in that the introduction passage 13*c* is provided at the inner peripheral surface of the sleeve 4 while the advanced angle annular flow passage 9*a* connecting the advanced angle communication passage 14*a* and the advanced angle flow passage 8*a* to each other and the retarded angle annular flow passage 9*b* connecting the retarded angle communication passage 14*b* and the retarded angle flow passage 8*b* to each other are provided at the outer peripheral surface of the sleeve 4. The other construction is similar to the first embodiment.

[Other Embodiments]

1. In the valve opening and closing timing control apparatus, an intermediate member which transmits the rotation of the inner rotor to the camshaft and which is cylindrically formed and made of steel, for example, may be provided between the inner rotor and the camshaft in the direction of the rotation axis. In this case, the inner rotor and the intermediate member collectively correspond to the driven-side rotation member.

2. In the valve opening and closing timing control apparatus, the introduction passage which brings the working fluid supplied from the outside to flow along the longitudinal direction of the rotation axis may be configured by an elongated groove provided at both the outer peripheral surface of the bolt and the inner peripheral surface of the tubular member between the bolt and the tubular member.

INDUSTRIAL APPLICABILITY

The present invention is applicable to a valve opening and closing timing control apparatus mounted at an internal combustion engine of various applications other than an internal combustion engine of an automobile.

EXPLANATION OF REFERENCE NUMERALS

1: housing (driving-side rotation member)
2: camshaft
3: inner rotor (driven-side rotation member)
4: sleeve (tubular member)
5: bolt
6: positioning portion
7*a*: advanced angle chamber
7*b*: retarded angle chamber
8*a*: advanced angle flow passage
8*b*: retarded angle flow passage
9*a*: advanced angle annular flow passage
9*b*: retarded angle annular flow passage
12*a*: spool (control valve body)
13*c*: introduction passage
13*d*: introduction communication passage
14*a*: advanced angle communication passage
14*b*: retarded angle communication passage
A: valve opening and closing timing control apparatus
E: engine (internal combustion engine)
E2: crankshaft (drive shaft)

The invention claimed is:

1. A valve opening and closing timing control apparatus comprising a driving-side rotation member synchronously rotating with a drive shaft of an internal combustion engine;

a driven-side rotation member supported at an inner side of the driving-side rotation member to be rotatable at a rotation axis serving as a common rotation axis between the driven-side rotation member and the driving-side rotation member, the driven-side rotation member integrally rotating with a camshaft for opening and closing a valve of the internal combustion engine;

a tubular member provided at an inner portion of the driven-side rotation member;

a bolt in a tubular form provided at an inner side of the tubular member to connect the driven-side rotation member and the camshaft to each other;

an advanced angle chamber and a retarded angle chamber defined and provided between the driving-side rotation member and the driven-side rotation member;

an advanced angle flow passage and a retarded angle flow passage provided at the driven-side rotation member, the advanced angle flow passage being in communication with the advanced angle chamber, the retarded angle flow passage being in communication with the retarded angle chamber;

an introduction passage provided at least at one of the bolt and the tubular member between the bolt and the tubular member, the introduction passage extending along a longitudinal direction of the rotation axis and bringing a working fluid supplied from an outside to flow along the longitudinal direction of the rotation axis;

an introduction communication passage provided at the bolt to bring the working fluid at the introduction passage to flow to an inner side of the bolt;

an advanced angle communication passage and a retarded angle communication passage provided at different positions from each other along the longitudinal direction of the rotation axis of the bolt; and a control valve body provided at the inner side of the bolt to reciprocate along the rotation axis, the control valve body supplying the working fluid from the introduction communication passage to one of the advanced angle communication passage and the retarded angle communication passage, wherein the tubular member is externally fitted and fixed to the bolt.

2. The valve opening and closing timing control apparatus according to claim 1, wherein the advanced angle communication passage and the retarded angle communication passage penetrate through the bolt and the tubular member in a direction intersecting with the rotation axis, the advanced angle communication passage and the retarded angle communication passage being provided at different positions from each other along a circumferential direction of the rotation axis relative to the introduction passage so that the working fluid at the inner side of the bolt flows separately to the advanced angle flow passage and the retarded angle flow passage.

3. The valve opening and closing timing control apparatus according to claim 1, further comprising a positioning portion which determines a relative position between the bolt and the tubular member in the circumferential direction relative to the rotation axis, the positioning portion being provided at and over the bolt and the tubular member.

4. The valve opening and closing timing control apparatus according to claim 1, further comprising a positioning portion which determines a relative position between the bolt and the tubular member in a direction along the rotation axis, the positioning portion being provided at and over the bolt and the tubular member.

5. The valve opening and closing timing control apparatus according to claim 1, wherein a relative position between the bolt and the tubular member is determined by fitting of the bolt and the tubular member to each other.

6. The valve opening and closing timing control apparatus according to claim 1, wherein the tubular member is made of one of an aluminum-based material and a resin material.

7. The valve opening and closing timing control apparatus according to claim 1, wherein the introduction passage is provided at an outer peripheral surface of the bolt while an advanced angle annular flow passage connecting the advanced angle communication passage and the advanced angle flow passage to each other and a retarded angle annular flow passage connecting the retarded angle communication passage and the retarded angle flow passage to each other are provided at an inner peripheral surface of the driven-side rotation member.

8. The valve opening and closing timing control apparatus according to claim 1, wherein the introduction passage is provided at an outer peripheral surface of the bolt while an advanced angle annular flow passage connecting the advanced angle communication passage and the advanced angle flow passage to each other and a retarded angle annular flow passage connecting the retarded angle communication passage and the retarded angle flow passage to each other are provided at an outer peripheral surface of the tubular member.

9. The valve opening and closing timing control apparatus according to claim 1, wherein the introduction passage is provided at an inner peripheral surface of the tubular member while an advanced angle annular flow passage connecting the advanced angle communication passage and the advanced angle flow passage to each other and a retarded angle annular flow passage connecting the retarded angle communication passage and the retarded angle flow passage to each other are provided at an inner peripheral surface of the driven-side rotation member.

* * * * *